United States Patent [19]

Hoeptner

[11] Patent Number: 5,003,945

[45] Date of Patent: Apr. 2, 1991

[54] DUAL SPARK PLUG IGNITION SYSTEM FOR MOTORCYCLE INTERNAL COMBUSTION ENGINE

[75] Inventor: Herbert W. Hoeptner, Morgan Hill, Calif.

[73] Assignee: Custom Chrome, Inc., Morgan Hill, Calif.

[21] Appl. No.: 413,337

[22] Filed: Sep. 28, 1989

[51] Int. Cl.[5] ..... F02P 15/02

[52] U.S. Cl. ..... 123/310; 123/638

[58] Field of Search ..... 123/146.5 A, 310, 621, 123/622, 638, 640

[56] References Cited

U.S. PATENT DOCUMENTS 2,025,202 12/1935 Harper, Jr. ..... 123/638 X
2,643,274 6/1953 Miller ..... 123/638
4,177,782 12/1979 Yoshinari et al. ..... 123/638
4,710,598 12/1987 McAbee et al. ..... 123/146.5 A X

FOREIGN PATENT DOCUMENTS 37215 4/1978 Japan ..... 123/638
93964 6/1983 Japan ..... 123/638
96130 6/1983 Japan ..... 123/310

*Primary Examiner*—Tony M. Argenbright
*Attorney, Agent, or Firm*—William W. Haefliger

[57] ABSTRACT

An ignition system for a motorcycle two cylinder internal combustion engine includes magnetically coupled primary and secondary coils, two spark plugs at each of the cylinders, a source of electrical current, contacts controlling electrical current flow to the primary coil for producing high voltage output from the secondary coils to be delivered to the spark plugs.

1 Claim, 2 Drawing Sheets

DUAL SPARK PLUG IGNITION SYSTEM FOR MOTORCYCLE INTERNAL COMBUSTION ENGINE

BACKGROUND OF THE INVENTION

This invention relates generally to motorcycle engine ignition systems, and, more particularly, to the provision of supplemental spark plugs in such systems to effect, better combustion, and make use of lower octane fuel.

In dual cylinder motorcycle engine ignition systems, the use of two plugs per cylinder has resulted in less than desirable power delivery to the plugs when coupled with one wire from the ignition coil. There is need to optimize power delivery to dual plugs per cylinder (four plugs total) from the coil.

There is need for improvements in contact induced ignition at the spark plugs of two-cylinder, motorcycle engines of the above type.

SUMMARY OF THE INVENTION

It is a major object of the invention to provide an improved motorcycle engine ignition system that meets the above need, and there is also need for such an ignition system characterized by low cost, high efficiency, and reliability. Basically, the improved system of the present invention includes magnetically coupled primary and secondary coil means, dual spark plugs at each of the cylinders, a source of electrical current, and contacts controlling electrical current flow to the primary coil mean for producing high voltage outputs from the secondary coil means to be delivered to the multiple spark plugs. In that system the combination of the invention includes magnetically coupled primary and secondary coil means, two spark plugs at each of the cylinders, a source of electrical current, and contacts controlling electrical current flow to the primary coil means for producing high voltage outputs from the secondary coil means to be delivered to all the spark plugs, the secondary coil means including secondary coil means A operatively connected via the primary coil means with both of the spark plugs at one cylinder, and secondary coil means B connected via the primary coil means with both of the spark plugs at the other cylinder As will be seen, the spark plugs employed in the system include two plugs at each cylinder; and the plugs at one cylinder may be connected with secondary coil means A, while the plugs at the second cylinder may be connected with secondary coil means B. Further, the primary coil means may include primary coil means A' magnetically coupled to the secondary coil means A, and primary coil means B' magnetically coupled to the secondary coil means B. The coil means A' and B' may be directly interconnected electrically. Use of dual plugs at each cylinder facilitates smoother ignition.

These and other objects and advantages of the invention, as well as the details of an illustrative embodiment, will be more fully understood from the following specification and drawings, in which:

DRAWING DESCRIPTION

FIG. 1 is a diagrammatic view of an ignition system embodying the invention; and FIG. 2 is a exploded view of ignition system components.

DETAILED DESCRIPTION

Figure 1:
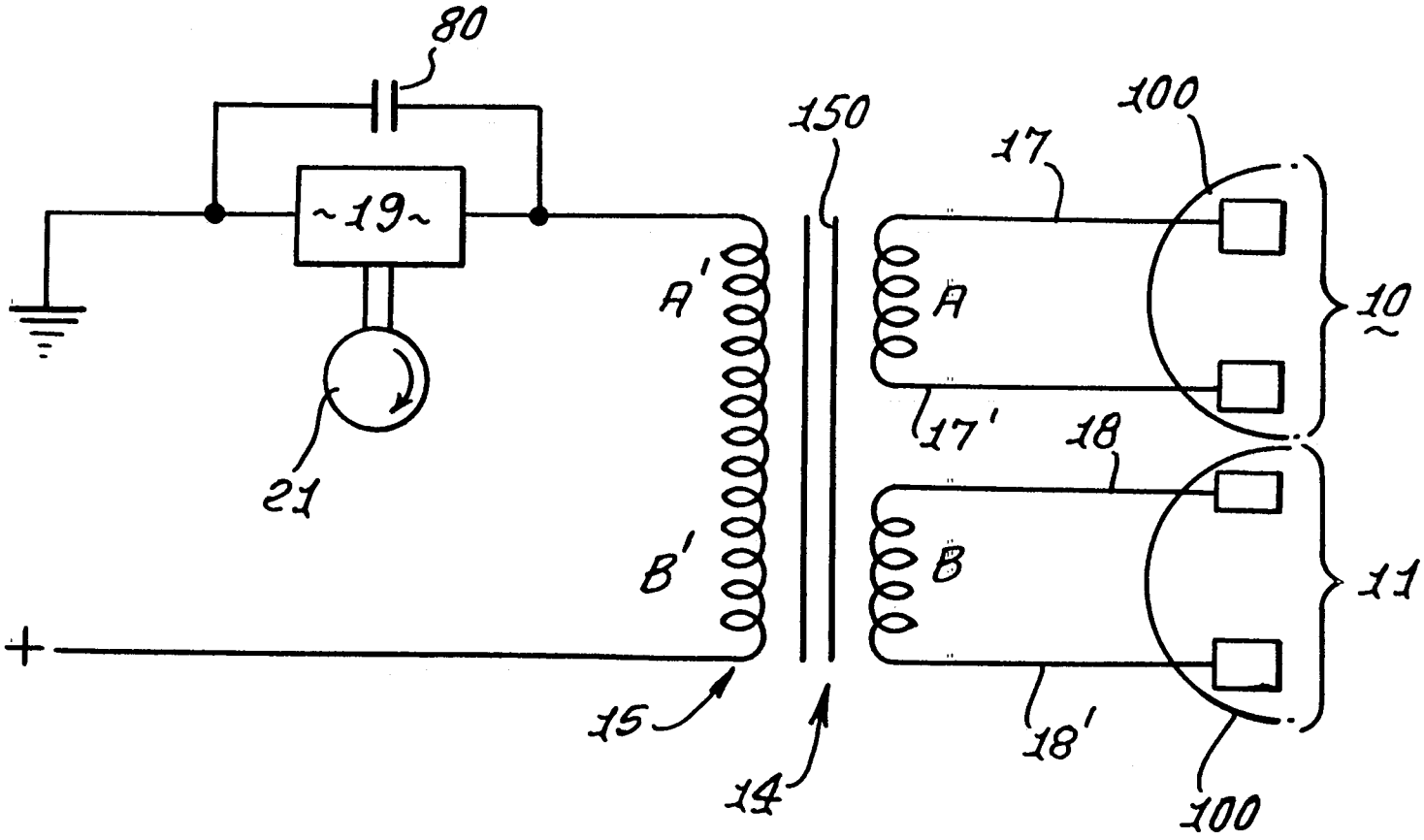

In FIG. 1, dual spark plugs 10 and 11 are located respectively at two-cylinder, motorcycle engine cylinders, i.e., dual plugs at each cylinder 100. Magnetically coupled primary and secondary coil means 14 includes lower voltage primary coil means A' and B', and higher voltage secondary coil means A and B shown connected at 17, 17', 18, and 18' with the spark plugs. Contact unit 19 is provided for controlling electrical current flow to the primary coil means A' and B', for producing high voltage outputs from the secondary coil means to be delivered to all the plugs. See also condenser 80. Thus, all plugs fire when one cylinder is to be fired, and all plugs fire when the other cylinder is to be fired. Normally the two cylinders are to be fired at crankshaft relative positions 0° and 180°.

Figure 2:
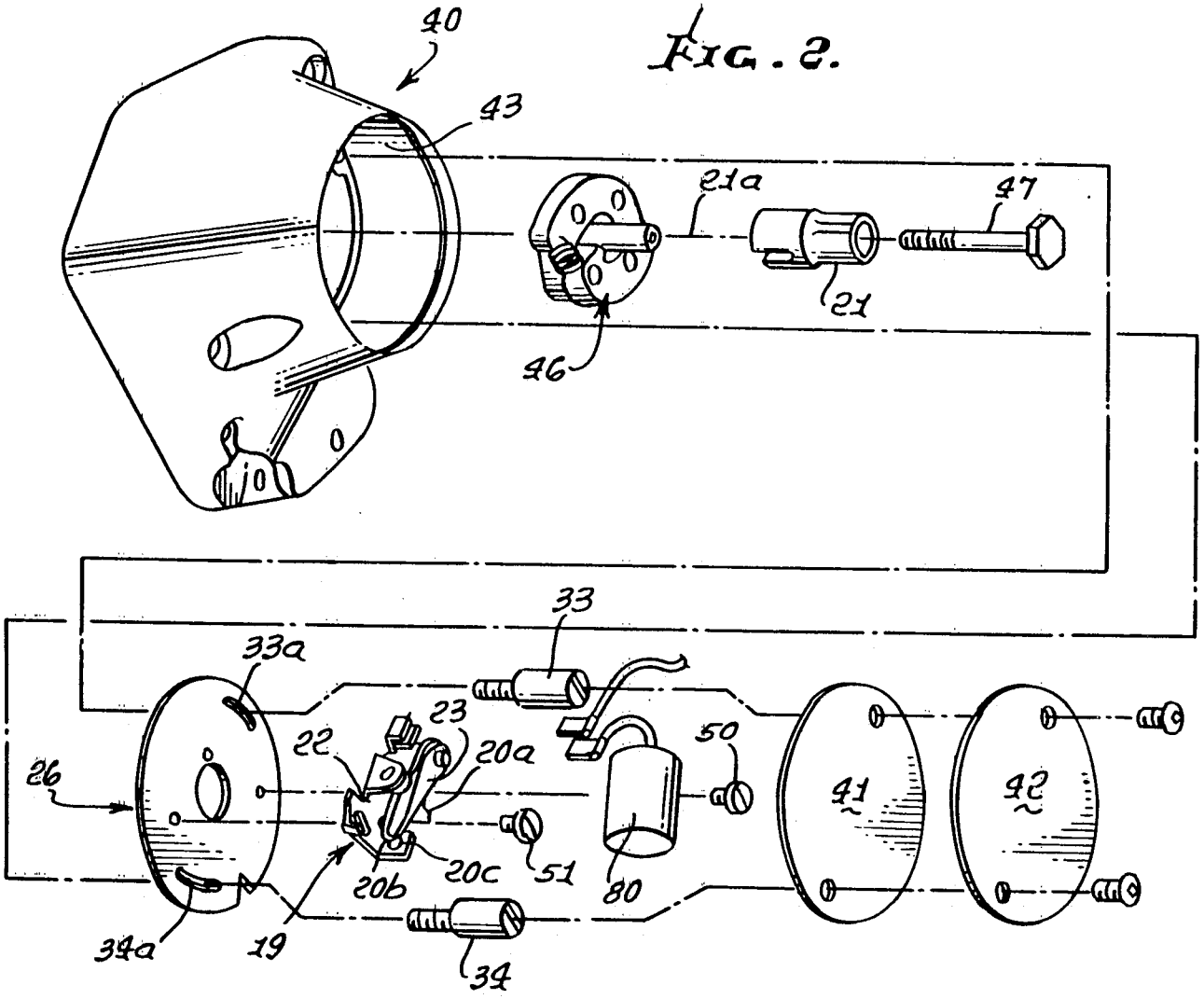

As seen in FIG. 2, the assembly also includes rotary cam means, such as camshaft 21, driven, i.e., rotated, by the engine for controlling timed opening of the contacts. The camshaft is rotated about axis **21*a* so that it engages the follower finger 20*a* on the contact unit 19 at each firing time. Contact points are shown as at 20*b* and 20*c*, to be opened and closed in response to camshaft rotation. The unit 19 includes, in addition, two pivotally connected arms 22 and 23**, and a coil spring (not shown) tending to close the arms toward one another, the cam and follower interengagement tending to deflect an arm to open the points at the optimum time during the engine piston stroke in each cylinder to fire the compressed combustible charge in the cylinder.

For timing purposes, carrier means are provided, carrying the contact unit, as via fasteners 50 and 51, and being adjustably rotatable about axis **21*a* to an adjusted position. The carrier means is referenced in FIG. 2 at 26, it being a thin plate which may be insulative. Plate 26 is suitably carried in a housing or body 40, and attached via fasteners 33 and 34 passing through adjustment slots 33*a* and 34*a*. A gasket 41 and cover plate 42 cover and close the opening 43** in the housing via which the described elements are assembled into the housing, and via which they are easily accessible for adjustment and replacement.

Unit 46 carries the camshaft, as via a fastener 47, and adjustably rotates the camshaft for spark advance purposes, as is known. The engine drives unit 46.

FIG. 1 also shows a primary coil 15 coupled via core 150 to secondary coil sections A and B. Coil 15 may be considered to embody integrated sections A' and B'. Two spark plugs 10 are connected with opposite ends of A and attached to one cylinder; two spark plugs 11 are connected with opposite ends of B, and attached to the other cylinder 100. In FIG. 1, capacitor 80 is connected across the contact points, as shown.

I claim:

1. In an ignition system for a motorcycle two cylinder internal combustion engine, the system including magnetically coupled primary and secondary coil means, two spark plugs at each of the cylinders, a source of electrical current, and a single set of contacts controlling electrical current flow to the primary coil means for producing high voltage outputs from the secondary coil means to be delivered to all four of the spark plugs, said secondary coil means including certain secondary coil means operatively connected via the primary coil means with both of the spark plugs at one cylinder, and other secondary coil means connected via the primary coil means with both of said spark plugs at the other cylinder, a single cam controlling only said contacts, and a single magnetic core between said primary coil means and both said secondary coil means, and wherein said spark plugs include:

two plugs at one cylinder and connected with said certain secondary coil means, two plugs at the second cylinder and connected with said other secondary coil means, said primary coil means including certain primary coil means magnetically coupled to said certain secondary coil means, and other primary coil means magnetically coupled to said other secondary coil means, said certain and other primary coil means being connected in series, electrically, said two spark plugs at one cylinder being electrically connected to opposite ends of said certain secondary coil means, and said two spark plugs at the other cylinder are electrically connected to opposite ends of said other secondary coil means, and including (a) said cam driven by the engine for controlling opening of the contacts, the cam rotatable about a first axis, (b) carrier means carrying the contacts, and adjustably rotatable about said axis, (c) and non-rotary support means to which said carrier means is connected, in adjusted position of the contacts, (d) whereby the timing of spark effected ignitions by all the spark plugs may be simultaneously controlled.

* * * * *